US005242057A

United States Patent [19]

Cook et al.

[11] Patent Number: 5,242,057

[45] Date of Patent: Sep. 7, 1993

[54] CONVENIENCE KIT FOR DISPENSING DIFFERENT PERSONAL HYGIENE COMPONENTS

[75] Inventors: Charles D. Cook, Fairfield; Mark J. Steinhardt, Cincinnati, both of Ohio

[73] Assignee: The Procter & Gamble Company, Cincinnati, Ohio

[21] Appl. No.: 992,325

[22] Filed: Dec. 21, 1992

[51] Int. Cl.[5] ..... B26D 85/62; B65D 83/00

[52] U.S. Cl. ..... 206/581; 206/233; 206/494; 206/812; 220/480; 221/34; 221/45; 221/48

[58] Field of Search ..... 206/223, 229, 233, 494, 206/581, 812, 823; 220/476, 480; 221/33-35, 44, 45, 48, 63

[56] References Cited

U.S. PATENT DOCUMENTS

| | | | |
|---|---|---|---|
| 1,628,981 | 5/1927 | Horwitt . | |
| 2,118,473 | 5/1938 | Morris | 206/57 |
| 2,387,059 | 10/1945 | Clark | 206/57 |
| 2,473,932 | 6/1949 | Wolf | 206/57 |
| 2,611,482 | 9/1952 | Nelson | 206/57 |
| 2,619,226 | 11/1952 | Adams | 206/56 |
| 2,823,089 | 2/1958 | DeFranco | 312/39 |
| 3,306,492 | 2/1967 | Kugler | 221/63 |
| 3,499,575 | 3/1970 | Rockefeller | 221/55 |
| 3,514,014 | 5/1970 | Skowronski | 221/46 |
| 4,002,264 | 1/1977 | Marchesani | 221/63 |
| 4,131,195 | 12/1978 | Worrell, Sr. | 206/205 |
| 4,185,754 | 1/1980 | Julius | 221/63 |
| 4,192,420 | 3/1980 | Worrell, Sr. et al. | 206/205 |
| 4,332,319 | 6/1982 | Hurwood | 206/210 |
| 4,550,855 | 11/1985 | Harrison | 221/63 |
| 4,627,117 | 12/1986 | Morishita | 4/247 |
| 4,651,874 | 3/1987 | Nakamura | 206/205 |
| 4,739,879 | 4/1988 | Nakamura | 206/205 |
| 4,741,944 | 5/1988 | Jackson et al. | 428/152 |
| 4,790,436 | 12/1988 | Nakamura | 206/449 |
| 4,796,751 | 1/1989 | Madkour | 206/494 |
| 4,863,064 | 9/1989 | Dailey, III | 221/48 |
| 4,875,242 | 10/1989 | Albrecht et al. | 4/243 |
| 4,881,278 | 11/1989 | Farah | 4/243 |
| 4,887,321 | 12/1989 | MacLean | 4/243 |
| 4,899,905 | 2/1990 | Holtsch | 221/63 |
| 4,903,837 | 2/1990 | Duello | 206/494 |
| 4,979,613 | 12/1990 | McLaughlin et al. | 206/233 |
| 5,025,524 | 6/1991 | Genovese, Jr. | 15/104.94 |
| 5,048,718 | 9/1991 | Nakamura | 221/63 |
| 5,076,465 | 12/1991 | Lawson | 221/47 |
| 5,111,934 | 5/1992 | Morin | 206/812 |

FOREIGN PATENT DOCUMENTS

| | | | |
|---|---|---|---|
| 893001 | 2/1972 | Canada . | |
| 2914590 | 10/1980 | Fed. Rep. of Germany | 206/494 |
| 2560763 | 3/1984 | France . | |
| 810146 | 1/1981 | South Africa . | |
| 907835 | 7/1991 | South Africa . | |
| 2238286A | 11/1989 | United Kingdom . | |

OTHER PUBLICATIONS

Just'N' Case, Sai Packaged Products (purchased in the U.S.).

Personal Care Kit, Made in The Netherlands by a Division of Cometform (purchased in the U.K.).

Sani Seat, Austin House Inc. (purchased in the U.S.).

Seaties, Apothecary Products, Inc. (purchased in the U.S.).

Myseat Toilet Seat Covers, Lenar Inc. (purchased in the U.S.).

Puffs To Go, The Procter & Gamble Company.

Testing: Product Description Product Sample (Blue and White Stripes).

*Primary Examiner*—Jimmy G. Foster

*Attorney, Agent, or Firm*—Gerry S. Gressel; Larry L. Huston; Fredrick H. Braun

[57] ABSTRACT

A personal care convenience kit is disclosed which dispenses different personal hygiene components in a sequential, one at a time fashion through a single dispensing opening. The convenience kit includes a compliant package having a first dispensing opening, and at least two different personal hygiene components ordered with respect to the first dispensing opening. The compliant package can include an auxiliary dispensing opening for dispensing at least one of the different components out of sequence.

25 Claims, 7 Drawing Sheets

CONVENIENCE KIT FOR DISPENSING DIFFERENT PERSONAL HYGIENE COMPONENTS

FIELD OF THE INVENTION

The present invention is generally related to packages for dispensing personal care items. More particularly, this invention is concerned with compliant, portable personal care convenience kits containing different components.

BACKGROUND OF THE INVENTION

Public restrooms are maintained by many public and private organizations for the convenience of persons away from home. Sanitary conditions in such restrooms are often poor. Examples include unhygienic surfaces such as are found on visibly dirty wash basins, faucet handles, and toilet seats. Further, even where the restroom appears to be well maintained, users may perceive that conditions are unsanitary because the facilities are used by strangers, or because of the potential for non-visible contamination of the facilities.

Such public restrooms may or may not provide personal care supplies such as soap or moistened sanitary wipes, toilet paper, and toilet seat covers. Additionally, even is such personal items are present, their condition may be unhygienic. For example, a roll of toilet paper may be soiled, may be of poor quality, or may have a leading end touching the floor. Therefore, there is a need for a package of personal care items that can be easily carried on trips away from home for use in public restrooms.

Disposable toilet seat covers are known in the art. Disposable toilet seat cover dispensers are sometimes found in public restrooms, but the dispenser may be empty, or the toilet seat cover soiled. Examples of disposable toilet seat covers are disclosed in the following references: U.S. Pat. No. 2,387,085 issued Oct. 16, 1945 to Clark; U.S. Pat. No. 4,627,117 issued Dec. 9, 1986 to Morishita; U.S. Pat. No. 4,875,242 issued Oct. 24, 1989 to Albrecht et al.; U.S. Pat. No. 4,887,321 issued Dec. 19, 1989 to MacLean; and French Patent Application 2,560,763 published Sep. 13, 1985 by Regenwetter. Packages for dispensing dry or premoistened sheets of tissue are also known in the art. Premoistened tissue can be used to clean the toilet seat prior to use, or to clean the hands after using the restroom facilities. Examples of such packages of dry or premoistened tissue are disclosed in the following references: U.S. Pat. No. 1,628,981 issued May 17, 1927 to Horwitt; U.S. Pat. No. 2,118,473 issued May 24, 1938 to Morris; U.S. Pat. No. 2,619,226 issued Nov. 25, 1952 to Adams; U.S. Pat. No. 2,823,089 issued Feb. 11, 1958 to Franco; U.S. Pat. No. 3,306,492 issued Feb. 28, 1967 to Kugler; U.S. Pat. No. 3,499,575 issued Mar. 10, 1970 to Rockefeller; U.S. Pat. No. 3,514,014 issued May 26, 1970 to Skowronski; U.S. Pat. No. 4,002,264 issued Jan. 11, 1977 to Marchesani: U.S. Pat. No. 4,131,195 issued Dec. 26, 1978 to Worrell; U.S. Pat. No. 4,185,754 issued Jan. 29, 1980 to Julius; U.S. Pat. No. 4,192,420 issued Mar. 11, 1980 to Worrell, Sr. et al.; U.S. Pat. No. 4,550,855 issue Nov. 5, 1985 to Harrison; U.S. Pat. No. 4,741,944 issued May 3, 1988 to Jackson et al.; U.S. Pat. No. 4,863,064 issued Sep. 5, 1989 to Dailey; U.S. Pat. No. 4,979,613 issued Dec. 25, 1990 to McLaughlin et al.; U.S. Pat. No. 5,076,465 issued Dec. 31, 1991 to Lawson; Canadian Patent 893001 issued Feb. 15, 1972 to Contini; and South African Patent Application 810146 published Dec. 17, 1981, in the name of Nampak Products Limited.

Such packages of tissue sheets typically only contain one or more pieces of a single component, such as a number of pieces of moistened tissue, or a length of moistened tissue. Such an arrangement is disadvantageous because the user must carry a package for each component. For example, the user must carry one package for moistened tissue and one package for dry tissue.

Because of the poor conditions found in many public restrooms, users typically wish to minimize the time spent in the public restroom, and accordingly wish to eliminate the wasted time and inconvenience of handling multiple packages. Worse yet, the user may forget one of the single component packages. In addition, multiple packages increase the cost to the user. Multiple packages also increase the amount of material that must be disposed of in landfills.

Different personal care components contained in one package are also known in the art. Examples of such packages are disclosed in the following references: U S. Pat. No. 4,332,319 issued Jun. 1, 1982 to Hurwood; U.S. Pat. No. 4,651,874 issued Mar. 24, 1987 to Nakamura; U.S. Pat. No. 4,739,879 issued Apr. 26, 1988 to Nakamura; U.S. Pat. No. 4,790,436 issued Dec. 13, 1988 to Nakamura; U.S. Pat. No. 4,881,278 issued Nov. 21, 1989 to Farah; South African Patent Application 9007835 published Jul. 31, 1991 by Coetzee; and U.K. Patent Publication 2,238,286A published May 29, 1991 by Levin.

Such packages have different components in separate sealed compartments, or have different components that dispense as a group from an opening. Those packages having different components in separate sealed compartments are not convenient. As mentioned above, users typically wish to minimize the time spent in the public restroom, and accordingly do not want to open a sealed compartment for each personal care item.

Furthermore, packages having different components that come out of the package together are rot convenient because components that come out of the package at the same time cannot be used at the same time. Separate components may be withdrawn from the package in an order different than the order of intended use, requiring the user to juggle multiple components while using the restroom facilities.

Further, because of the poor lighting conditions often found in public restrooms, it may be difficult to visually distinguish the different components in the package. Therefore, it may be necessary to withdraw all of the components from the package in order to locate one desired component. While the user is attempting to withdraw the desired component, other components can be misplaced, fall out of the package onto the floor, or otherwise become contaminated during handling. Handling of multiple components simultaneously is further complicated when the user is holding other items, such as a purse, or is supervising small children. In addition, components which come out of a package at the same time typically require substantial unfolding or handling prior to being ready for use.

Accordingly, it is an object of the present invention to provide a personal care convenience kit which dispenses different personal hygiene components in a sequential, one at a time fashion through a single dispensing opening. It is a further object of the present invention to provide a convenience kit having different personal hygiene components ordered with respect to a single dispensing opening, so that the different components can be withdrawn one at a time in the order in which they are to be used. Yet another object of the present invention is to provide a convenience kit for dispensing different personal hygiene components so that a plurality of the different personal hygiene components are substantially ready to use upon dispensing. Yet another object of the present invention is to provide a convenience kit for different personal hygiene components such that a plurality of the different components at least partially unfold as they are dispensed. Still another object of the present invention is to provide a convenience kit which has an auxiliary dispensing opening for dispensing at least one of the different personal hygiene components out of sequence.

BRIEF SUMMARY OF THE INVENTION

The present invention comprises a personal care convenience kit having a compliant package, a first dispensing opening, and at least two different personal hygiene components disposed in the compliant package. The different components are ordered with respect to the first dispensing opening to provide sequential, one at a time dispensing of the different components through the first dispensing opening. The compliant package can also include an auxiliary dispensing opening for dispensing at least one of the different components out of sequence.

The compliant package can have first and second generally oppositely facing sidewalls peripherally joined to form a pocket therebetween. The first dispensing opening can be covered with a releasable closure, and can be an elongated opening centrally located on the first sidewall. The auxiliary dispensing opening can be located on the second sidewall, and can comprise a line of perforations on the second sidewall.

The different personal hygiene components are disposed in the pocket formed by the sidewalls, and can comprise a toilet seat cover, a length of tissue paper, and a liquid impermeable packet containing a moistened wipe.

The different components are preferably ordered with respect to the first dispensing opening so that the toilet seat cover is dispensed first, the tissue paper is dispensed second, and the packet containing the moistened wipe is dispensed third.

The convenience kit can also have an adhesive mounting means for temporarily securing the convenience kit to a surface. The adhesive mounting means can be located on the second sidewall.

The convenience kit can be held in one hand, or temporarily secured to a surface. The different components can be ordered for dispensing one at a time in the order in which they are needed. Therefore, the user does not have to search for a desired component, or handle multiple components at one time. Further, the components are not exposed before they are needed, and therefore are not contaminated prior to use. In addition, the user can choose to leave components not needed for a particular restroom visit protected inside the package. Two or more of the different components can at least partially unfold upon dispensing, and thereby be substantially ready for use.

DESCRIPTION OF THE DRAWINGS

While the specification concludes with claims particularly pointing out and distinctly claiming the invention, it is believed the invention will be better understood with reference to the following associated drawings, wherein like features are given the same reference numeral, and:

DETAILED DESCRIPTION OF THE INVENTION

Figure 1:
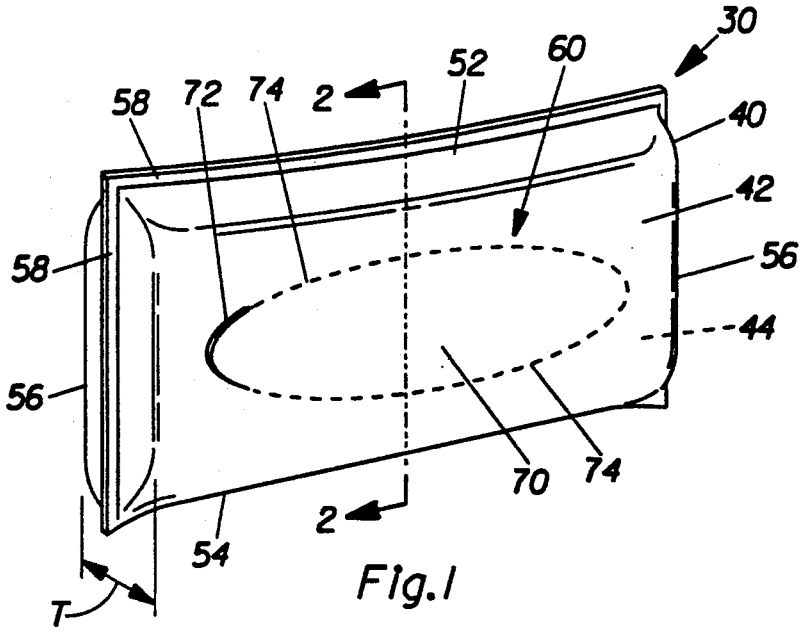
FIG. 1 is a perspective view of a personal care convenience kit showing the first dispensing opening covered by a releasable closure.

Referring to FIGS. 1 through 4, the present invention comprises a personal care convenience kit, designated generally by reference numeral 30. The personal care convenience kit 30 comprises a compliant package 40 having a first dispensing opening 60, and at least two different personal hygiene components 120 and 130 disposed in the compliant package 40. The different personal hygiene components 120 and 130 are ordered with respect to the first dispensing opening 60 to provide sequential, one at a time dispensing of the different components 120 and 130 through the first dispensing opening 60.

Figure 2:
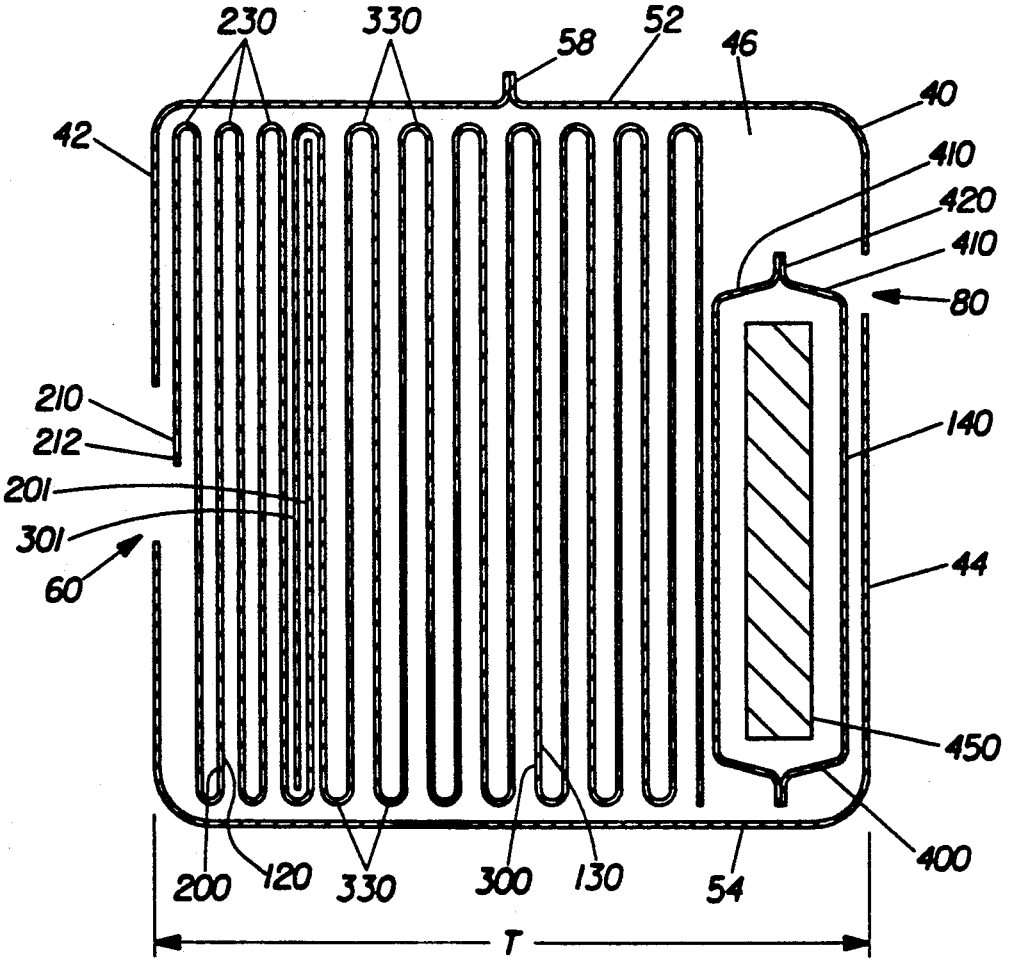
FIG. 2 is a cross-sectional view taken along lines 2—2 in FIG. 1 illustrating the ordered sequencing of the folded toilet seat cover, the folded length of tissue, and the moisture impervious packet containing the moistened wipe with respect to the first dispensing opening, and showing the position of the auxiliary dispensing opening.

The personal care convenience kit 30 can comprise additional different personal hygiene components, such as component 140. Referring to FIG. 2, component 130 is spaced from first dispensing opening 60 by component 120, and component 140 is spaced from first dispensing opening 60 by components 120 and 130, so that the components 120, 130 and 140 are dispensed through first dispensing opening 60 in numerical sequence. The compliant package 40 can have an auxiliary dispensing opening 80 for dispensing at least one of the different components, such as component 140, out of sequence.

Before examining the elements of the personal care convenience kit 30 in greater detail, a brief description of terminology is in order. The term "personal care convenience kit" refers to portable kits which can be conveniently carried, such as in a pocket or purse, and which contain personal hygiene components. A "compliant package" refers to a package that is flexible and which can easily bend and conform to external forces, such as when the package is carried in a person's pocket.

The term "personal hygiene components" refers to items which can be used for personal cleaning before or after using lavatory facilities, or items which can be used to prevent personal contact with surfaces in restrooms. Personal hygiene components include but are not limited to facial or tissue paper, moistened wipes, paper toweling, soap, and toilet seat covers. The term "different personal hygiene components" refers to personal hygiene components that are physically and visually distinct, although such different components may be formed of the same material and have interchangeable functions. For instance, tissue paper and toilet seat covers can be formed from the same material, and can in some circumstances be used interchangeably, but are nonetheless physically and visually distinct.

In a preferred embodiment, personal hygiene component 120 comprises a longitudinally and laterally folded toilet seat cover 200 adjacent the first dispensing opening 60. The personal hygiene component 130 comprises a longitudinally folded length of tissue paper 300 spaced from the first dispensing opening 60 by the toilet seat cover 200, i.e., the toilet seat cover 200 is interposed between the opening 60 and the 15 tissue paper 300. The personal hygiene component 140 comprises a moisture impervious packet 400 containing one or more moistened wipes 450, wherein the moisture impervious packet 400 is spaced from the dispensing opening 60 by the toilet seat cover 200 and the length of tissue paper 300, i.e., tissue paper 300 is interposed between the toilet seat cover 200 and the packet 400.

The sequenced dispensing from first dispensing opening 60 wherein the toilet seat cover 200 is dispensed first, the length of tissue paper 300 is dispensed second, and the moisture impervious packet 400 containing the moistened wipe 450 is dispensed third is preferred. Such a dispensing sequence is preferred because it reflects what is believed to be the most convenient and frequent order of use of these components 200, 300, and 400.

Other preferred dispensing sequences include, but are not limited to, toilet seat cover 200, moisture impervious packet 400 with moistened wipe 450, tissue paper 300; and 2) moisture impervious packet 400 with moistened wipe 450, toilet seat cover 200, and tissue paper 300. In addition, a toilet seat cover 200, tissue paper 300, and a moisture impervious packet 400 containing a moistened wipe 450 can be sequenced with respect to each other in different orders, or with respect to other components, without departing from the scope of the present invention. The more detailed description of the elements of the preferred personal care convenience kit 30 having a longitudinally and laterally folded toilet seat cover 200, a longitudinally folded length of tissue paper 300, and a moisture impervious packet 400 containing a moistened wipe 450 is provided below.

Compliant Package

The compliant package 40 illustrated in FIGS. 1–5 has a first sidewall 42 peripherally joined to a second sidewall 44 to form a pocket 46 therebetween. The folded toilet seat cover 200, the folded length of tissue paper 300, and moisture impervious packet 400 containing a moistened wipe 450 are disposed in the pocket 46 intermediate the first sidewall 42 and the second sidewall 44. Sidewalls 42 and 44 are peripherally joined at a top edge 52, a bottom edge 54, and side edges 56.

The first sidewall 42 has a first dispensing opening 60 centrally located on the first sidewall 42. A releasable closure panel 70 covers the first dispensing opening 60 prior to use of the kit 30. An auxiliary opening 80 on the second sidewall 44 can comprise a line of weakening of compliant package 40, such as a score line or a line of perforations 82 which can be torn for access to the moisture impervious packet 400 containing the moistened wipe 450. An adhesive mounting means 90 for temporarily securing the kit 30 to a surface can be positioned on the kit 30. The adhesive mounting means 90 is preferably centrally located on the second sidewall 44. Alternatively, the adhesive mounting means 90 can be located on the first sidewall 42. A releasable strip 92 covers the adhesive mounting means 90 prior to use.

Figure 3:
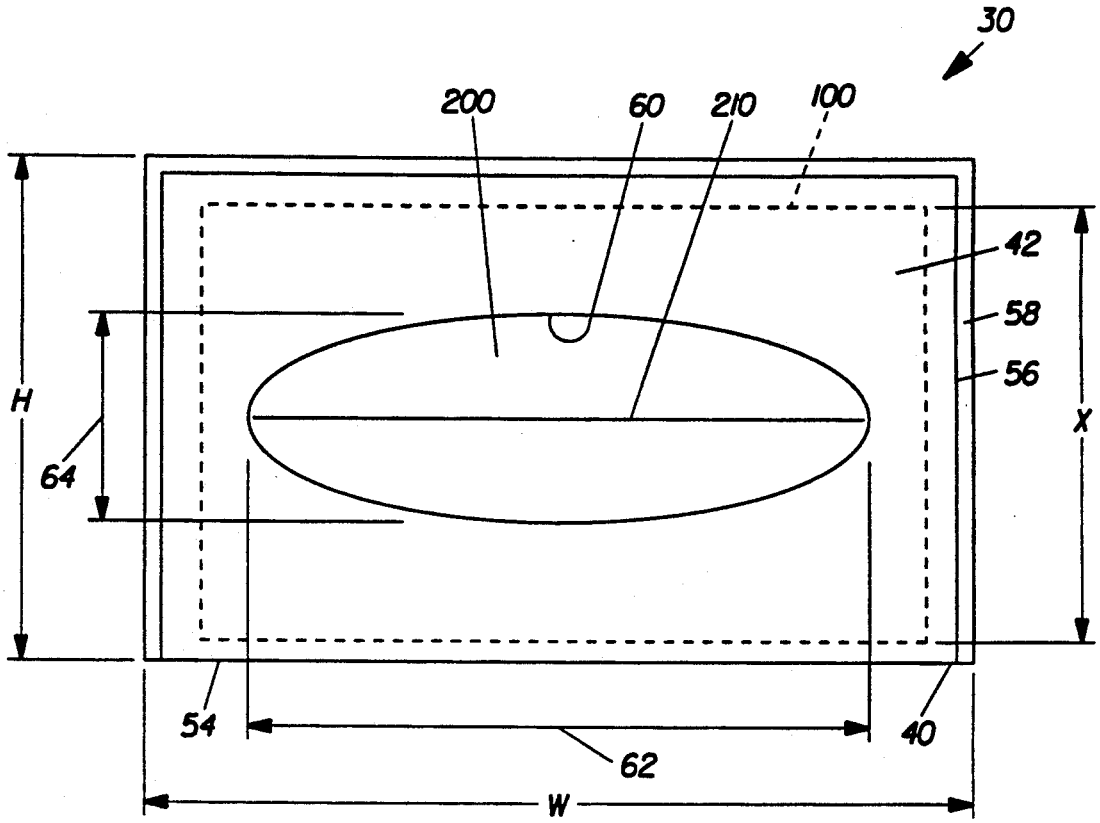
FIG. 3 is a frontal view of the convenience kit illustrating the relative dimensions of the first dispensing opening, and showing the projected area of the components.
Figure 4:
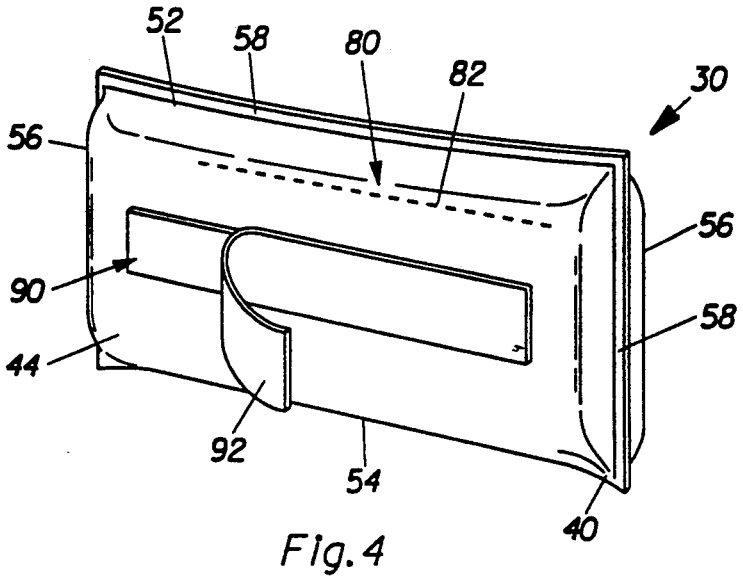
FIG. 4 is a perspective view of the personal care convenience kit showing the auxiliary dispensing opening and an adhesive mounting means.

Referring to FIG. 3, the first dispensing opening 60 is preferably centrally located on the first sidewall 42 for convenient handling and dispensing, and is sized and shaped to promote longitudinal unfolding of the folded toilet seat cover 200 and longitudinal unfolding of the folded length of tissue paper 300 upon their respective dispensing. The opening 60 is also sized and shaped to prevent the folded toilet seat cover 200 and the folded length of tissue paper 300 from unintentionally falling out of the package 30, or from being dispensed simultaneously rather than sequentially. Thus, the first dispensing opening 60 is a restrictive opening because it provides a restriction to the withdrawal of at least some of the different components 200, 300, and 400.

In a preferred embodiment, the area of first dispensing opening 60 is less than the projected area of the folded toilet seat cover 200 and less than the projected area of the folded length of tissue paper 300, thereby providing a restriction to the simultaneous or unintentional withdrawal of components 200 and 300. The projected areas of the toilet seat cover 200 and tissue paper 300 are indicated in phantom by reference numeral 100 in FIG. 3. The first dispensing opening 60 is preferably elongated with a major axis 62 and a mutually orthogonal minor axis 64. The length of the major axis 62 is preferably at least 5/3 times the length of the minor axis 64 to promote longitudinal unfolding of the toilet seat cover 200 and the length of tissue paper 300. The projected areas 100 of the folded toilet seat cover 200 and the folded length of tissue paper 300 have a dimension x which is parallel to the minor axis 64 of the first dispensing opening 60. The minor axis 64 is preferably no more than ½ the dimension x to restrict withdrawal of the folded toilet seat cover 200 and the folded length of tissue paper 300, and to promote longitudinal unfolding during dispensing.

The compliant package 40 comprises a flexible material which permits the package 40 to bend and conform to the movements of the person carrying and holding the package 40. A flexible material is also desirable for preferred dispensing and longitudinal unfolding of the toilet seat cover 200 and length of tissue paper 300 from the first dispensing opening 60. Such a flexible material can comprise but is not limited to a cellulosic material, a thin metallic film, cellophane, acetate, or a film made from a synthetic resin such as polyethylene, polypropylene, polyvinyl chloride, or polyamide.

In one embodiment, the compliant package 40 can be formed from a material that dissolves in water, so that the package 40 is flushable. For example, the package 40 can be formed from a polyvinyl alcohol film. Such a film is available from the Monosol Division of Chris Craft Industrial Products, Gary, Ind., as Monosol 7050 film.

Alternatively, the compliant package 40 can be moisture impervious. A preferred construction comprises a low density polyethylene film, having a thickness of between about 0.0254 mil) and 0.0559 millimeters (2.2 mils). Such a film is commercially available from the Sengewald Company of Marengo, Ill., under the designation CBAP-1, Specification Number 635565.

The compliant package shown in FIGS. 1–4 can be made by cutting a sheet of low density polyethylene film into a generally rectangular shape approximately 16.5 centimeters (6.5 inches) long and approximately 14.0 centimeters (5.5 inches) wide. One half of the sheet corresponds to the first sidewall 42 and the other half of the sheet corresponds to the second sidewall 44.

The sheet of polyethylene film can be placed on a perforation die, and pressure can then be applied to create the perforations 74 and the perforations 82. The series of perforations 74 are centrally located on the half of the sheet comprising the first sidewall 42. The perforations 74 and 82 can be approximately 3 millimeters long and 2 millimeters apart. Referring to FIGS. 1 and 3, the releasable closure panel 70 is generally elliptical in shape, and is sized to provide an opening 60 having a major axis 62 of about 10.2 centimeters (4.0 inches) and a mutually orthogonal minor axis 64 of about 3.18 centimeters (1.25 inches). The releasable closure panel 70 can have a first end 72 which is completely severed from the sheet, and a second unperforated end 76. The first and second ends 72 and 76 extend about 0.95 centimeters (0.375 inch) along the major axis 62 of the first dispensing opening 60. The first end 72 provides a tab for grasping releasable closure panel 70, and the second end 76 prevents the releasable closure panel 70 from being completely separated from the first sidewall 42.

An alternative closure panel 70 can be made to be resealable by sizing the panel 70 to overlap the first sidewall 42 by about 0.64 centimeters around the entire perimeter of the first dispensing opening 60. A double sided adhesive can be applied to the portion of the closure panel 70 overlapping the first sidewall 42, to form a releasable seal between the closure panel 70 and the first sidewall 42. A suitable adhesive comprises a double sided high tack/medium tack tape, such as is available from the Minnesota Mining and Manufacturing Company of St. Paul, Minn. as product number 9425.

The sheet of polyethylene film can then be folded in half to form sidewalls 42 and 44 joined at the bottom edge 54. Each of the sidewalls 42 and 44 has a width W of about 14.0 centimeters (5.5 inches) and a height H of about 8.26 centimeters (3.25 inches). Sidewalls 42 and 44 can then be joined at side edges 56 with approximately 3 millimeter wide heat seals 58.

The folded toilet seat cover 200, the folded length of tissue paper 300, and the moisture impervious packet 400 can then be inserted into the pocket 46 at the open top edge 52. The sidewalls 42 and 44 can then be joined at the top edge 52 with an approximately 3 millimeter wide heat seal 58. Referring to FIG. 2, the folded toilet seat cover 200 can include a portion 201 which is interfolded with a portion 301 of the folded length of tissue paper 300. Such interfolding helps to draw the portion 301 of the folded length of tissue paper 300 into opening 60 upon dispensing of the folded toilet seat cover 200. The folded toilet seat cover 200 also preferably has a dispensing edge 210 which intersects first dispensing opening 60.

The compliant package 40 has a thickness T of about 1.9 centimeters (0.75 inch) when the components 200, 300, and 400 are inserted therein. The thickness T is exaggerated in FIG. 2 to illustrate the components 200, 300, and 400.

The adhesive mounting means 90 can comprise a high tack/low tack double sided tape, with the high tack side of the tape applied to the sidewall 44. A suitable double sided tape is available from the Minnesota Mining and Manufacturing Company of St. Paul, Minn. as product number 9415PC.

Figure 5:
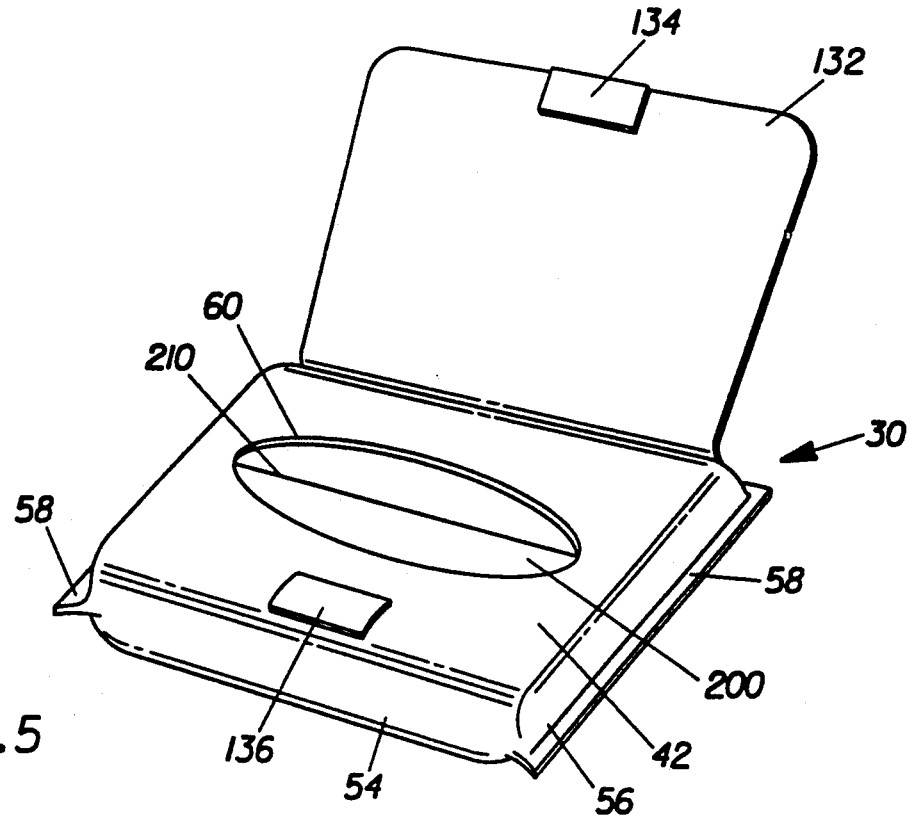
FIG. 5 is a perspective view of an embodiment of the personal care convenience kit having a closure flap.
Figure 6:
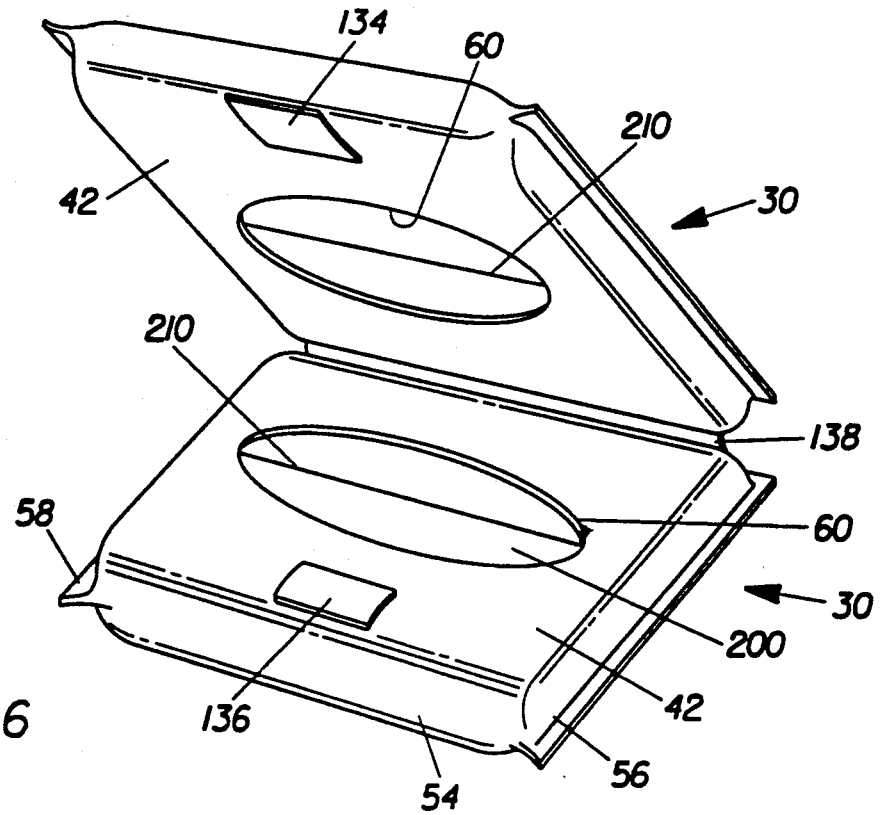
FIG. 6 is a perspective view of an embodiment of the personal care convenience kit wherein two compliant packages are connected at a folding hinge.

Alternate embodiments of the personal care convenience kit 30 are shown in FIGS. 5 and 6. FIG. 5 illustrates a convenience kit 30 having a flap 132 and first and second fastening elements 134 and 136. The flap 132 can replace or supplement releasable closure panel 70. U.S. Pat. No. 4,979,613 issued Dec. 25, 1990 to McLaughlin et al. discloses such a flap 132 and fastening construction, and is incorporated herein by reference for the purpose of showing fastening elements suitable for use with the claimed invention. In another embodiment, two or more personal care convenience kits 30 can be joined edge to edge. FIG. 6 shows such an arrangement where two personal care convenience kits 30 are joined at a flexible hinge 138. The flexible hinge 138 can include a line of weakening, such as a line of perforations, so that attached kits 30 can be separated. It will be apparent to one skilled in the art the two kits 30 could be joined at edges other than those shown, and that more than two kits 30 could be joined together.

Folded Toilet Seat Cover

Figure 7:
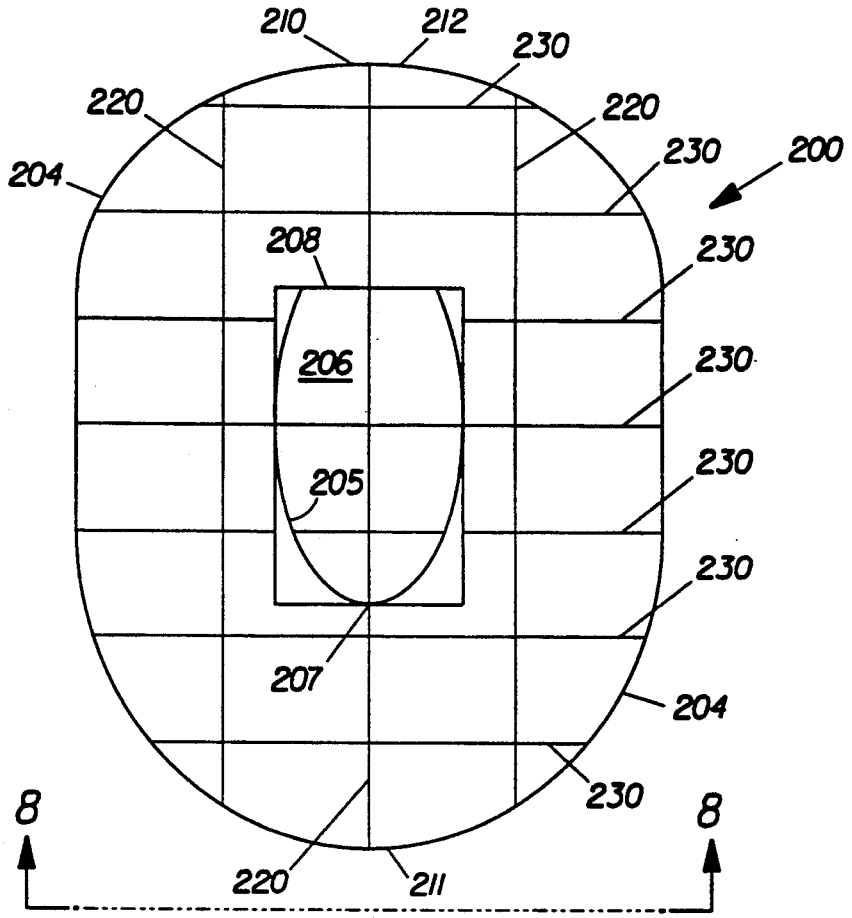
FIG. 7 is a plan view of an unfolded toilet seat cover showing laterally and longitudinally extending fold lines.
Figure 9:
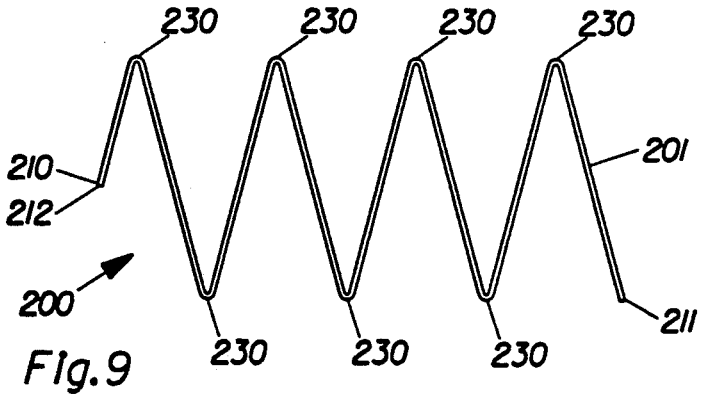
FIG. 9 is a schematic illustration of the toilet seat cover of FIG. 7 showing longitudinal folding of the toilet seat cover after the toilet seat cover has been laterally folded.
Figure 8:
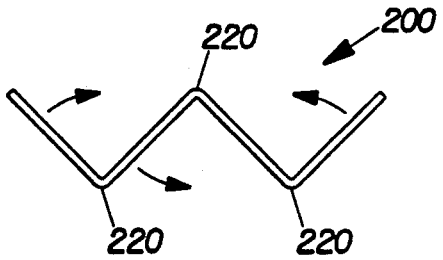
FIG. 8 is an end view of the toilet seat cover of FIG. 7 taken along lines 8—8 in FIG. 7 showing lateral folding of the toilet seat cover.

FIGS. 7–9 illustrate the toilet seat cover 200 in various stages of folding. FIG. 7 is a plan view of an unfolded toilet seat cover 200. Toilet seat cover 200 is cut from a rectangular sheet of tissue paper made from softwood or hardwood pulp. The toilet seat cover 200 preferably has a basis weight of about 0.0029 gram per square centimeter (0.006 pounds per square foot). The toilet seat cover preferably has a caliper of at least 0.028 to 0.030 centimeters (0.011 to 0.012 inches) as measured with a VIR Electronic Thickness Tester, Model 89-II with an applied load of 14.7 grams per square centimeter (0.21 pound per square inch) and a circular load footprint of 20.2 square centimeters (3.14 square inches). Such a thickness tester is made by the Thwing Albert Instrument Company of Philadelphia, Pa. The toilet seat cover 200 preferably has machine and cross machine direction tensile strength values of about 233 grams per inch and 167 grams per inch, respectively, as measured with an Intelect STD II Model 1451-24 tensile test machine with a cross head separation rate of 10.2 centimeters per minute (4 inches per minute), a sample length between cross heads of about 5.08 centimeters (2.0 inches), and a sample width of 2.54 centimeters (1.0 inch). Such a tensile test machine is commercially available from the Thwing Albert Instrument Company.

The tissue paper from which the toilet seat cover 200 is manufactured can be made according to the teachings of U.S. Pat. No. 3,301,746 issued Jan. 31, 1967, to Sanford et al., which patent is herein incorporated by reference for the purpose of showing a suitable material for the toilet seat cover 200. Other suitable materials from which toilet seat cover 200 may be made include but are not limited to glassine and plastic films.

The toilet seat cover 200 is cut to have a generally rounded or oval perimeter 204, and a flush flap 206 having a free perimeter 205. The flush flap 206 has a rearward connection to the toilet seat cover 200 along hinge 208.

The toilet seat cover 200 extends longitudinally from a front end 211 to a rearward end 212, and preferably has a longitudinal length of at least 50.4 centimeters (19.8 inches) and a lateral width of at least 41.9 centimeters (16.5 inches), so that the toilet seat cover 200 longitudinally and laterally overhangs a toilet seat.

The toilet seat cover 200 has longitudinally extending fold lines 220 and laterally extending fold lines 230. Longitudinally extending fold lines 220 are spaced apart about 10.7 centimeters (4.2 inches), and laterally extending fold lines 230 are spaced apart about 6.98 centimeters (2.75 inches) (corresponding to the dimension x in FIG. 3). The toilet seat cover 200 may be first laterally folded along fold lines 220, as shown in FIG. 8. The toilet seat cover 200 is then longitudinally folded along fold lines 230, as shown in FIG. 9, to provide a dispensing edge 210 which intercepts the first dispensing opening 60. The toilet seat cover 200 longitudinally unfolds upon dispensing. By "longitudinally unfold" it is meant that the toilet seat cover 200 unfolds along fold lines 230 when the toilet seat cover 200 is withdrawn through first dispensing opening 60.

The dispensing edge 210 corresponds to the rearward end 212 of the toilet seat cover 200. The user can grasp the dispensing edge 210 and withdraw the toilet seat cover 200 through the opening 60. The position, size, and shape of the elongated opening 60 relative to the projected area of the withdrawn toilet seat cover 200 promotes longitudinal unfolding of the toilet seat cover 200. The user can then shake the withdrawn toilet seat cover 200 to laterally unfold the toilet seat cover 200.

Figure 10:
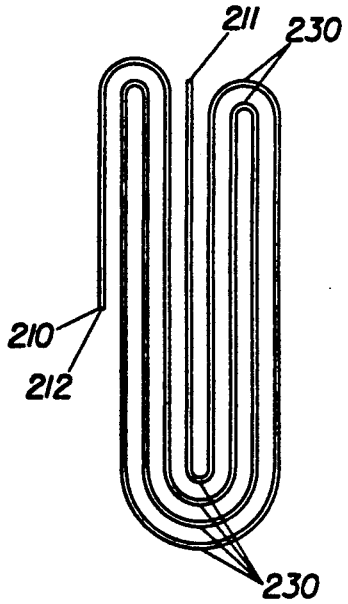
FIG. 10 is a side view of the toilet seat cover of FIG. 7 showing an alternate longitudinal folding pattern of the toilet seat cover.

An alternative longitudinal folding arrangement for the toilet seat cover 200 is shown in FIG. 10. The folded toilet seat cover 200 can be first folded along fold lines 220, as shown in FIG. 8. The toilet seat cover 200 is then folded along the fold lines 230 as shown in FIG. 10.

Length of Tissue Paper

Figure 11:
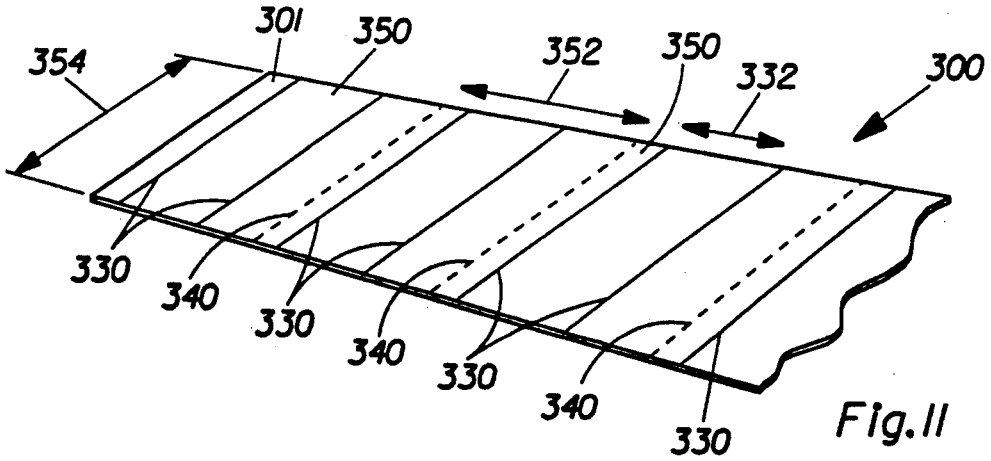
FIG. 11 is a perspective view of a length of tissue paper showing laterally extending fold lines and laterally extending lines of perforations.

The tissue paper 300 illustrated in FIG. 11 is preferably a two ply tissue which can be made from softwood or hardwood pulp. The two ply tissue paper 300 preferably has a basis weight of about 0.0040 grams per square centimeter (0.0083 pound per square foot) and a caliper of about 0.041 centimeter (0.016 inch), measured using the test equipment and procedure described above for the toilet seat cover 200. The tissue paper 300 preferably has machine and cross machine direction tensile strengths of about 260 grams per inch and 190 grams per inch, respectively, and a perforation tensile strength of about 130 grams per inch. These tensile strengths are measured using the equipment and procedure described above for the toilet seat cover 200.

The tissue paper 300 can be made according to the teachings of U.S. Pat. No. 4,191,609 issued Mar. 4, 1980, to Trokhan, and U.S. Pat. No. 4,529,480 issued Jul. 16, 1985, to Trokhan, which patents are herein incorporated by reference for the purpose of showing a suitable material for the tissue paper 300.

The folded length of tissue paper 300 comprises tissue squares 350 connected at laterally extending lines of perforations 340. Each square 350 has a longitudinal length 352 of about 11.2 centimeters (4.4 inches), and a lateral width 354 of about 11.4 centimeters (4.5 inches). The tissue paper 300 has laterally extending fold lines 330 which have a longitudinal spacing 332 of about 6.98 centimeters (2.75 inches) (corresponding to the dimension x in FIG. 3). The length of tissue paper 300 is longitudinally folded along fold lines 330, and longitudinally unfolds upon dispensing. By "longitudinally unfold" it is meant that the folded length of tissue paper 300 unfolds along fold lines 330 as the length of tissue paper 300 is withdrawn through first dispensing opening 60.

The folded length of tissue paper 300 allows the user to withdraw only as much tissue paper 300 as is required at a given time, thereby avoiding the inconvenience and waste of multiple sheet dispensing. The user can withdraw some or all of the tissue paper 300. If only some tissue paper 300 is withdrawn, the portion of tissue paper 300 withdrawn can be separated from the portion of tissue paper 300 remaining in pocket 46 by tearing the tissue 300 along a line of perforations 340.

Moisture Impervious Packet and Moistened Wipe

Figure 12:
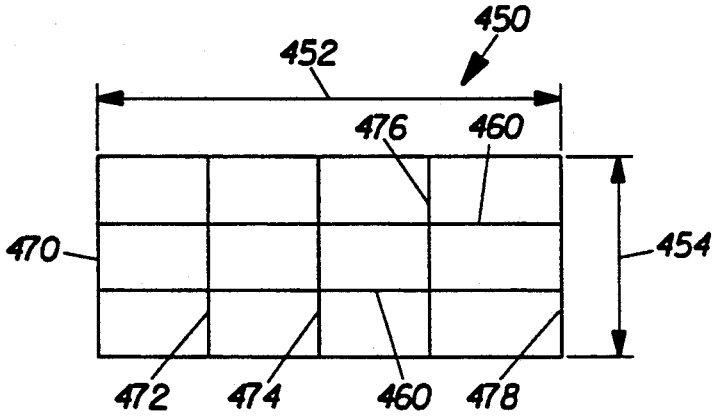
FIG. 12 is a plan view of an unfolded moistened wipe showing laterally and longitudinally extending fold lines.

The moistened wipe 450 shown unfolded in FIG. 12 preferably is formed from a dry 2 ply paper sheet. Each ply of the paper sheet preferably has a basis weight of about 0.0043 gram per square centimeter (0.0087 pounds per square foot) and a caliper of about 0.051 centimeter (0.020 inches) as measured using the test equipment and procedure described above for the toilet seat cover 200. Alternatively, the wipe 450 can be formed from a woven or nonwoven web of synthetic fibers.

The wipe 450 can be moistened with a mixture of water, polyethylene glycol, ethanol, lanolin, bacteriostats, and perfume. The moistened wipe 450 preferably has a length 452 of about 25.4 centimeters (10 inches) and a width 454 of about 15.2 centimeters (6 inches).

As shown in FIG. 12, the moistened wipe 450 has a pair of longitudinally extending fold lines 460. Fold lines 460 extend intermediate first and second ends 470 and 478 of the moistened wipe 450, and are spaced apart about 5.08 centimeters (2 inches).

The moistened wipe 450 also has a series of laterally extending fold lines 472, 474, and 476. Fold line 472 is equidistantly spaced about 6.03 centimeters (2.375 inches) from first end 470 and fold line 474. Fold line 476 is spaced about 6.03 centimeters (2.375 inches) from fold line 474, and about 7.30 centimeters (2.875 inches) from second end 478.

Figure 13:
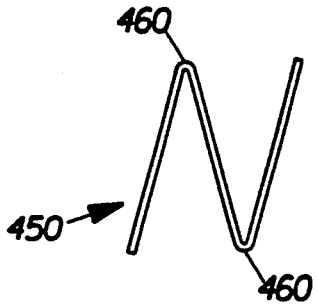
FIG. 13 is an end view of the moistened wipe of FIG. 12 showing lateral folding of the moistened wipe.
Figure 15:
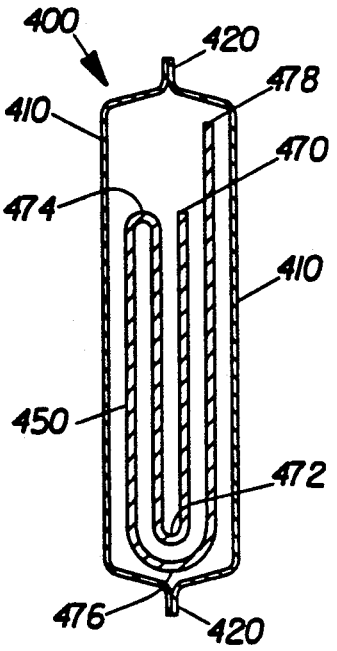
FIG. 15 is a cross-sectional view of the moistened wipe inside the moisture impervious packet.
Figure 14:
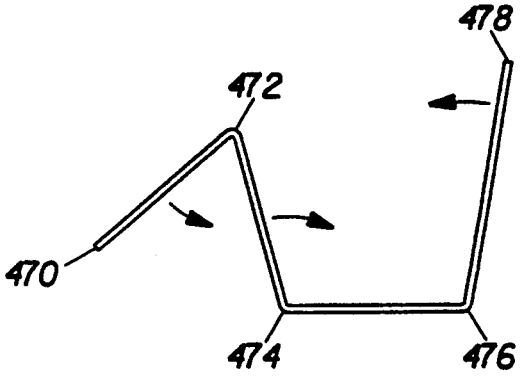
FIG. 14 is a schematic illustration of the moistened wipe of FIG. 12 showing longitudinal folding of the moistened wipe after the moistened wipe has been laterally folded.

The moistened wipe is first folded laterally along fold lines 460 as shown in FIG. 13. The moistened wipe is then longitudinally folded along fold lines 472, 474, and 476, as shown in FIGS. 14 and 15. FIG. 15 shows the folded moistened wipe 450 sealed in the moisture impervious packet 400. Because of the increased spacing between fold line 476 and second end 478, second end 478 extends above the fold line 474 and first end 470 when the moistened wipe 450 is folded inside packet 400, as shown in FIG. 15. The user can tear open the packet 400 and grasp end 478. Gravity can then cause the folded moistened wipe 450 to longitudinally unfold along fold lines 476, 474, and 472 once the moistened wipe 450 is pulled from the packet 400. The user can then shake the wipe 450 to laterally unfold it.

The automatic longitudinal unfolding of wipe 450 is enhanced by the two ply construction of moistened wipe 450 and the relatively high basis weight of each ply. Conventional folded moistened wipes do not easily unfold because the moistened folded sections of the conventional moistened wipes cling together.

The moisture impervious packet 400 preferably comprises two moisture impervious sheets 410 peripherally joined at edges 420, such as by heat sealing. Each sheet 410 can comprise a laminated construction. Preferably, each sheet 410 comprises a four layer construction comprising a first outer lamina of bleached paper having a basis weight of about 2.8 grams per square centimeter (5.7 pounds per square foot), a second lamina comprising a low density polyethylene film having a basis weight of about 0.68 grams per square centimeter (1.4 pounds per square foot), a third lamina of aluminum foil having a thickness of about 0.76 centimeters (0.0003 inch), and a fourth inner lamina comprising a low density polyethylene film having a basis weight of about 1.4 grams per square centimeter (2.9 pounds per square foot). A sheet 410 having such a laminated construction can have a thickness of about 0.010 centimeter (0.004 inch) and is commercially available from the Crown Zellerbach Company of Cincinnati, Ohio, as product number 9003.

A longitudinally and laterally folded moistened wipe 450 can be placed between two such sheets 410 so that the fourth inner lamina of each sheet 410 faces the moistened wipe 450. The sheets 410 can then be heat sealed along the four edges 420 at a temperature of about 177 degrees Centigrade (350 degrees Fahrenheit) at a pressure of about 2.8 kilograms per square centimeter (40 pounds per square inch), for about 0.5 second.

Figure 20:
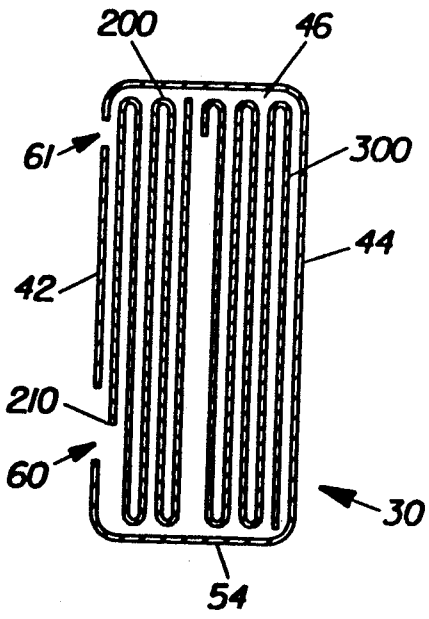
FIG. 20 is a cross-sectional view taken along lines 20—20 in FIG. 19.
Figure 19:
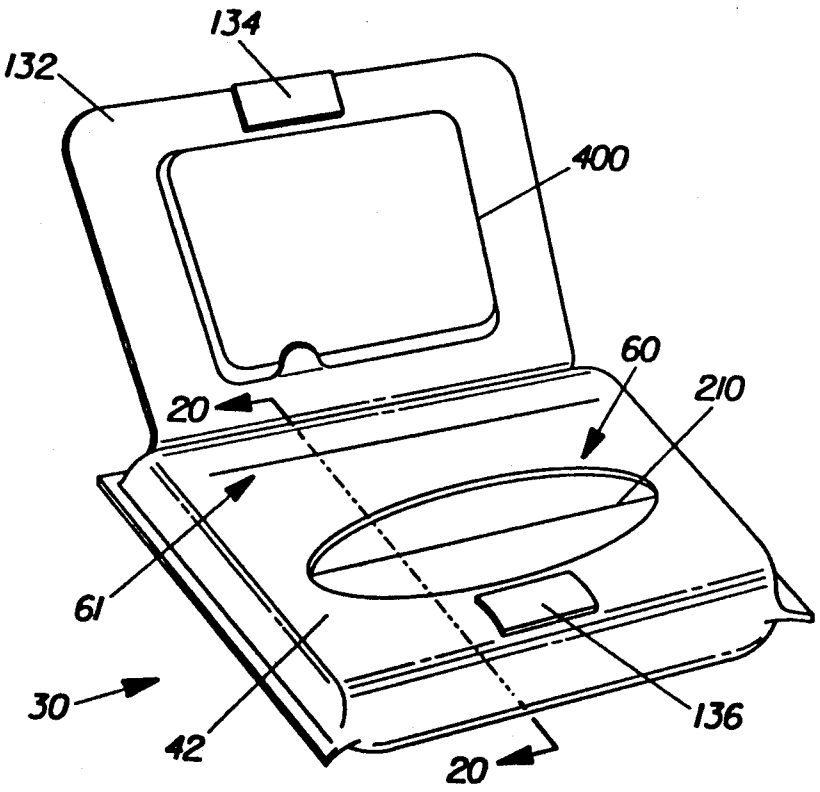
FIG. 19 is a perspective view of a personal care convenience kit having two dispensing openings in a first sidewall.

The compliant package 40 shown in FIGS. 1-4 has a single dispensing opening 60 in the first sidewall 42. However, the scope of the present invention includes a compliant package 40 having different components dispensed from two or more dispensing openings in the first sidewall 42, provided at least two different components can be sequentially dispensed through one of the two or more dispensing openings. This arrangement is shown in FIGS. 19 and 20, where a toilet seat cover 200 can be dispensed through a first dispensing opening 60, and a length of tissue paper 300 can be dispensed through a second dispensing opening 61 positioned in the first sidewall 42. Alternatively, both the toilet seat cover 200 and the length of tissue paper 300 can be sequentially dispensed through the first dispensing opening 60. The packet 400 can be adhesively attached to the flap 132 covering the dispensing openings 60 and 61.

Radially Ordered Components

Figure 16:
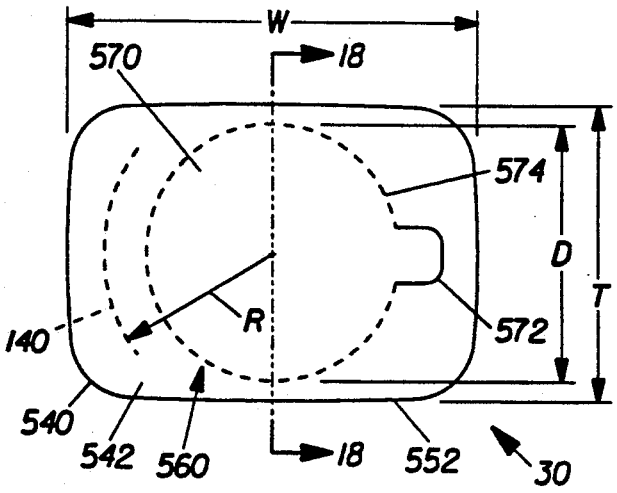
FIG. 16 is a top view of an alternative embodiment of the present invention.
Figure 17:
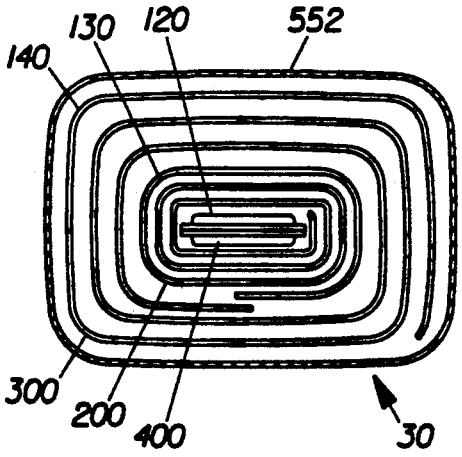
FIG. 17 is a schematic illustration of the top view of FIG. 16 with a top wall removed to show spiral wound, radially ordered components.
Figure 18:
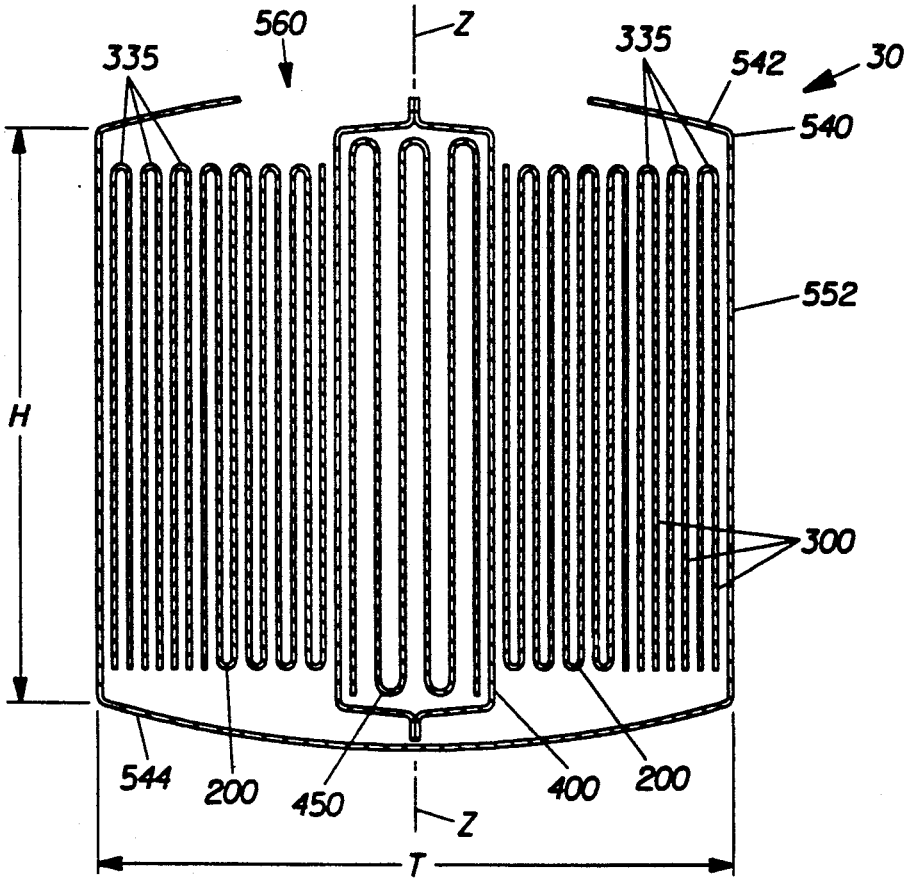
FIG. 18 is a schematic illustration of a cross-sectional view taken along lines 18—18 in FIG. 16.

FIGS. 16, 17, and 18 show an alternative embodiment of the present invention. The alternative embodiment provides a relatively compact convenience kit 30 with at least two different personal hygiene components 130 and 140. The components 130 and 140 are disposed within a compliant package 540 having a dispensing opening 560 formed in a top wall 542 of the compliant package 540.

The different components 130 and 140 are radially ordered with respect to the dispensing opening 560 to provide radially sequential, one at a time dispensing of the different components 130 and 140 through the dispensing opening 560. The convenience kit 30 can further comprise another component 120 which may or may not be radially ordered with the components 130 and 140.

FIG. 16 is a top view of such a convenience kit 30. FIG. 17 schematically illustrates a top view of the convenience kit 30 with the top wall 542 removed to show the different components 120, 130, and 140. FIG. 18 schematically illustrates a cross-section of the convenience kit 30 taken along lines 18—18 in FIG. 16.

The compliant package 540 includes the top wall 542, a bottom wall 544, and a sidewall 552 extending from the top wall 542 to the bottom wall 544. The dispensing opening 560 is preferably centrally located in the top wall 542 and can be generally circular with a diameter D. The compliant package 540 has a width W, a thickness T, and a height H.

The dispensing opening 560 is sized and shaped to restrict simultaneous dispensing of the different components 120, 130, and 140. Referring to FIG. 16 and 17, dispensing opening 560 can be sized and shaped so that at least a portion of one of the components 130 and 140 is disposed radially outward of dispensing opening 560, as illustrated by vector R and the portion of component 140 shown in phantom in FIG. 16. Diameter D is preferably less than width W and thickness T.

In one embodiment, diameter D can be about 3.5 centimeters (1.375 inch), width W can be about 5.08 centimeters (2.0 inches), thickness T can be about 3.81 centimeters (1.5 inch), and height H can be about 5.7 centimeters (2.25 inches). Thickness T is exaggerated in FIG. 18 to illustrate the different components 120, 130, and 140.

The compliant package 540 can be formed from the same low density polyethylene film used to form the compliant package 40. The dispensing opening 560 is preferably covered by a releasable closure panel 570 which can be formed by perforations 574 in the top wall 542. Closure panel 570 can include a tab 572 which can be grasped to tear closure panel 570 along perforations 574.

In a preferred embodiment component 130 comprises a spirally wound toilet seat cover 200, and component 140 comprises a spirally wound length of tissue paper 300. The toilet seat cover 200 and the tissue paper 300 are spirally wound about an axis z—z (FIG. 18) which is generally perpendicular to top wall 542 and dispensing opening 560. Component 120 can comprise a moisture impervious packet 400 containing a moistened wipe 450.

Referring to FIGS. 17 and 18, the toilet seat cover 200 can be spirally wound about the packet 400. The length of tissue paper 300 can then be spirally wound about the toilet seat cover 200 to be positioned radially outward of the toilet seat cover 200. The different components are dispensed in the order in which they are radially arranged: the packet 400 is dispensed first; the spirally wound toilet seat cover 200 is dispensed second; and the spirally wound tissue paper 300 is dispensed third. Frictional forces between the packet 400 and the toilet seat cover 200 prevent the packet 400 from falling out of the compliant package 540 before the packet 400 is needed. Likewise, frictional forces between the toilet seat cover 200 and the tissue paper 300 prevent the toilet seat cover 200 from falling out of the compliant package 540 if the diameter D of the dispensing opening 560 is sized to be greater than a maximum diameter of the spirally wound toilet seat cover 200.

In an alternative radially sequenced arrangement of the components 200, 300, and 400, the packet 400 can be positioned adjacent the bottom wall 544 or the sidewall 552. In either arrangement, the toilet seat cover 200 is dispensed first, the tissue paper 300 is dispensed second, and the packet 400 is dispensed third. An auxiliary dispensing opening can be provided in the bottom wall 544 or the sidewall 552 to permit out of sequence dispensing of the packet 400.

In order to provide a convenience kit 30 which is compact, the toilet seat cover 200 and the tissue paper 300 are preferably folded prior to being spirally wound about axis z—z. The toilet seat cover 200 is first folded laterally. The lateral folding of toilet seat cover 200 is shown schematically in FIG. 18. The toilet seat cover 200 is then spirally wound about packet 400 as shown schematically in FIG. 17. For clarity, only one layer of the spirally wrapped toilet seat cover 200 is shown in FIG. 18.

The length of tissue paper 300 is first folded laterally along a longitudinally extending fold line designated by numeral 335 in FIG. 18. The length of tissue paper is then spirally wound about the toilet seat cover 200, as shown in FIG. 17. For clarity, only three layers of the spirally wound length of tissue paper 300 are shown in FIG. 18.

The spirally wound, radially ordered components 200 and 300 shown in FIGS. 16–18 provide a convenience kit 30 which has a slightly greater thickness than the thickness of the convenience kit 30 shown in FIGS. 1–4. However, the convenience kit 30 with the spirally wound, radially ordered components is generally more compact than the convenience kit 30 shown in FIGS. 1–4.

While particular embodiments of the invention have been illustrated and described, various changes and modifications can be made to the present invention without departing from the spirit and scope of the present invention. The appended claims are intended to cover all such changes and modifications.

What is claimed:

1. A personal care convenience kit comprising:

a compliant package having a first dispensing opening; and at least two different personal hygiene components disposed inside the compliant package and dispensable through the first dispensing opening, at least a portion of a first one of the components being located intermediate the first dispensing opening and at least a portion of a second one of the components so as to inhibit dispensing of the second component until the first component has been dispensed, such that the components are ordered with respect to the first dispensing opening to provide sequential, one at a time dispensing of the different components through the first dispensing opening.

2. The convenience kit recited in claim 1 wherein the first dispensing opening restricts the different components from simultaneous dispensing.

3. The convenience kit recited in claim further comprising an auxiliary dispensing opening for dispensing at least one of the different components out of sequence.

4. The convenience kit recited in claim wherein the compliant package is moisture impervious.

5. The convenience kit recited in claim wherein the different components comprise a folded toilet seat cover and a folded length of tissue paper separate from the folded toilet seat cover.

6. The convenience kit recited in claim 5 wherein the different components further comprise a moisture impervious packet containing a moistened wipe.

7. The convenience kit recited in claim 5 wherein the folded length of tissue paper is spaced from the first dispensing opening by the folded toilet seat cover.

8. The convenience kit recited in claim 7 wherein the different components further comprise a moisture impervious packet containing a moistened wipe, and wherein the moisture impervious packet is spaced from the first dispensing opening by the folded toilet seat cover and the folded length of tissue paper.

9. The convenience kit recited in claim 7 wherein a portion of the folded length of tissue paper is interfolded with a portion of the folded toilet seat cover.

10. The convenience kit recited in claim 5 wherein the first dispensing opening has an area less than the projected area of the folded toilet seat cover and less than the projected area of the folded length of tissue paper.

11. The convenience kit recited in claim 10 wherein the first dispensing opening is centrally located on a package sidewall, the first dispensing opening is an elongated opening with mutually orthogonal major and minor axes, and the first dispensing opening major axis is generally parallel to fold lines on both the folded toilet seat cover and the folded length of tissue paper.

12. The convenience kit recited in claim 11 wherein the first dispensing opening major axis is at least 5/3 times as long as the first dispensing opening minor axis.

13. The convenience kit recited in claim 10 wherein the folded seat cover is folded longitudinally and laterally, and wherein the folded length of tissue paper is folded longitudinally.

14. The convenience kit recited in claim 13 wherein the folded toilet seat cover and the folded length of tissue paper longitudinally unfold upon withdrawal through the first dispensing opening.

15. The convenience kit recited in claim 1 further comprising an adhesive mounting means for temporarily securing the convenience kit to a surface.

16. A personal care convenience kit comprising:

a compliant package having a first sidewall peripherally joined to a generally oppositely facing second sidewall to form a pocket therebetween, an elongated first dispensing opening located on the first sidewall; and at least two different personal hygiene components disposed inside the pocket, at least a portion of a first one of the components being located intermediate the first dispensing opening and at least a portion of a second one of the components so as to inhibit dispensing of the second component until the first component has been dispensed, such that the components are ordered with respect to the first dispensing opening to provide sequential, one at a time dispensing of the different components through the first dispensing opening.

17. The convenience kit recited in claim 16 further comprising a second dispensing opening located on one of the sidewalls.

18. The convenience kit recited in claim 17 wherein the second dispensing opening is located on the first sidewall.

19. A personal care convenience kit comprising:

a compliant package having a first sidewall peripherally joined to a generally oppositely facing second sidewall to form a pocket therebetween, an elongated first dispensing opening located on the first sidewall, and an auxiliary dispensing opening located on the second sidewall;

a longitudinally and laterally folded toilet seat cover disposed in the pocket adjacent the first dispensing opening;

a longitudinally folded length of tissue paper disposed in the pocket, the folded length of tissue paper separate from, and adjacent to, the folded toilet seat cover, and the folded length of tissue paper spaced from the first dispensing opening by the folded toilet seat cover; and a liquid impermeable packet containing a moistened wipe, the liquid impermeable packet disposed in the pocket and spaced from the first dispensing opening by the folded length of tissue paper and the folded toilet seat cover, the liquid impermeable packet accessible through the auxiliary opening without removing the folded toilet seat cover and without removing the folded length of tissue paper.

20. The convenience kit recited in claim 19 further comprising an adhesive mounting means for temporarily securing the convenience kit to a surface, wherein the adhesive mounting means is disposed on the second sidewall.

21. A personal care convenience kit comprising:

a compliant package having a dispensing opening; and at least two different radially ordered personal hygiene components disposed inside the compliant package, at least a portion of a first one of the components being located intermediate the dispensing opening and at least a portion of a second one of the components so as to inhibit dispensing of the second component until the first component has been dispensed, whereby the package provides sequential, one at a time dispensing of the at least two different components through the dispensing opening.

22. The convenience kit recited in claim 21 wherein the dispensing opening restricts the different personal hygiene components from simultaneously dispensing.

23. The convenience kit recited in claim 21 wherein the different components comprise a toilet seat cover and a length of tissue paper separate from the toilet seat cover.

24. The convenience kit recited in claim 23 wherein the toilet seat cover is spirally wound, and wherein the length of tissue paper is spirally wound and disposed radially outward of the toilet seat cover.

25. The convenience kit recited in claim 24 wherein the different components further comprise a moisture impervious packet containing a moistened wipe.

* * * * *

UNITED STATES PATENT AND TRADEMARK OFFICE

CERTIFICATE OF CORRECTION

PATENT NO. : 5,242,057

DATED : SEPTEMBER 7, 1993

INVENTOR(S) : CHARLES D. COOK, MARK J. STEINHARDT

It is certified that error appears in the above-identified patent and that said Letters Patent is hereby corrected as shown below:

| | |
|---|---|
| Column 1, line 27 | "is" should read --if--. |
| Column 2, line 41 | "rot" should read --not--. |
| Column 5, line 59 | "the 15 tissue" should read --the tissue--. |
| Column 14, line 14 | "claim further" should read --claim 1 further--. |
| Column 14, line 18 | "claim wherein" should read --claim 1 wherein--. |
| Column 14, line 20 | "claim wherein" should read --claim 1 wherein--. |

Signed and Sealed this

Eleventh Day of October, 1994

*Attest:*

Bruce Lehman

BRUCE LEHMAN

*Attesting Officer*

*Commissioner of Patents and Trademarks*